US007377227B2

(12) United States Patent
LaRoche

(10) Patent No.: US 7,377,227 B2
(45) Date of Patent: May 27, 2008

(54) ANCHOR BRA

(76) Inventor: Jane G LaRoche, 30 Westdale St., Worcester, MA (US) 01604

( * ) Notice: Subject to any disclaimer, the term of this patent is extended or adjusted under 35 U.S.C. 154(b) by 103 days.

(21) Appl. No.: 10/987,774

(22) Filed: Nov. 13, 2004

(65) Prior Publication Data

US 2006/0102062 A1 May 18, 2006

(51) Int. Cl.
*B63B 17/00* (2006.01)
*B63B 21/24* (2006.01)

(52) U.S. Cl. ..... 114/361; 114/294; 114/364

(58) Field of Classification Search ..... 114/210, 114/219, 294, 311, 343, 361, 364; 440/71, 440/72; 150/154, 157; 416/247 R, 247 A
See application file for complete search history.

(56) References Cited

U.S. PATENT DOCUMENTS 4,004,625 A * 1/1977 Zietlow, Jr. ..... 383/40
4,579,077 A * 4/1986 Soules ..... 114/301
6,055,923 A * 5/2000 Militzer ..... 114/210
6,152,064 A * 11/2000 Morton ..... 114/361

FOREIGN PATENT DOCUMENTS

JP 2002029490 A * 1/2002

* cited by examiner

*Primary Examiner*—Ajay Vasudeva
(74) *Attorney, Agent, or Firm*—Francis H. Kirkpatrick

(57) ABSTRACT

An anchor bra provides an easily removable and replaceable cover over a protruding boat anchor, thereby protecting other boats and people from damage by an exposed anchor. The anchor bra is preferably formed of a buoyant and pliable marine grade plastic that covers a boat's anchor when it is raised. The anchor bra is secured in place by adjustable straps that are fastened to the boat's gunwale or railing. The anchor bra is made in various sizes to accommodate various anchor shapes and sizes.

13 Claims, 6 Drawing Sheets

ANCHOR BRA

BACKGROUND

The popularity of recreational boating has increased dramatically, and so the number of boaters and boats in marinas and on moorings has increased. Many boats are designed to have an exposed anchor at the bow of the boat when docked or under sail. When an anchor is not in use it is manually or mechanically hoisted and secured to the bow for storage. The mounting of the anchor on many boats leaves this piece of jagged metal extending beyond the bow of the boat with no protection. Many cases of severe damage occur when the exposed anchor comes in contact with another boat, object or person. Damage often happens when a mishap occurs while a boat is attempting to dock, resulting in an anchor hitting or being hit. When a boat is docked stern in, the part of the boat most exposed to collisions with other boats is the bow where the anchor is secured. When a boat is docked stern out, the bow and the anchor may be close to people on docks or gangways.

Some attempts have been made to solve this problem, but none has been widely accepted. For example, Rich et al, U.S. Pat. No. 5,524,569, have described an anchor cover which fits over the stock, but which does not appear to cover the flukes, or to be readily removable to allow use of the anchor. This incomplete solution does not seem to have met with commercial success. An improved and simplified anchor-protecting device is required.

SUMMARY OF THE INVENTION

The invention is an "anchor bra", i.e. a protective anchor cover that is configured to be attached by strapping it over a protruding anchor when the anchor is not in use. The anchor bra also can serve to protect an individual from an exposed anchor when a boat has docked with its bow into the slip. The anchor bra can also be attached to a boat in a mooring field to protect other boats from damage if contact occurs. The key feature of the anchor bra is its ability to yield sufficiently on contact with another boat, either resiliently (like a balloon) or non-resiliently (like a crushed foam), to prevent or minimize damage from the contact. A range of degrees of yielding are possible, depending on the particular material selected. At a minimum, one will select a material having an ability to yield on contact that is greater than that of the anchor.

The anchor bra comprises an anchor cover section, and connecting means attaching the anchor cover to the boat. In one aspect, the anchor bra's anchor cover is an air-containing closed structure, for example similar in manner of construction to a boat fender, with a particular shape that fits over a selected anchor. The anchor bra is secured to the boat by its attaching means, for example straps, ropes, elastic lines, or similar securing means. The apparatus is designed to be easily removed when the boat leaves its slip or mooring, and to be replaced when entering harbor.

In another aspect, the anchor bra is a shell or cup of an inflatable or rigid or crushable material, which covers an exposed anchor and is retained in place by straps, ropes, elastic lines or other securing means.

In another aspect, the invention is a method for preventing damage of other boats by a raised anchor on a first boat, the method comprising providing an anchor bra comprising an anchor cover and attachment means, and affixing it to the boat so as to at least partially cover the anchor.

In another aspect, the invention describes an anchor bra for protecting an anchor from damaging other boats, or people, wherein the anchor bra is simple enough to affix and to remove that such positioning can be accomplished while the boat is under way (i.e., in motion).

DESCRIPTION OF THE INVENTION

The anchor bra is a light, buoyant device that fits over the protruding portions of an anchor that, when raised, is retained in an exposed position on a boat, usually at the front. The anchor bra is removably attached to the boat by straps, lines, elastic cords, or similar fasteners, allowing it to be placed over the anchor, and to be removed from the anchor, while the boat is under way. In this context, "strap" is used to designate lines, ropes, flat straps, cords, bungee cords, and any functionally similar flexible means for attaching one object to another. The anchor bra alternatively could affix to the anchor directly, for example with hooks, loops, snaps, and the like. The affixing or securing means will preferably be arranged to allow the anchor bra to be deployed without the deploying person having to lean out over the anchor.

In a preferred embodiment, the anchor cover portion of the anchor bra is made of a strong, flexible plastic material, for example marine grade vinyl. The anchor bra is deformable, so that when contact is made between the raised anchor and another object, the impact is at least partially absorbed by the anchor bra, or is spread out over a larger area. The deformation can be reversible or irreversible. In a preferred embodiment, the bra is air filled, like conventional boat fenders. The anchor bra is preferably durable enough to absorb an impact of another boat or person making contact, without having to be replaced. Besides an air-filled bladder, a shell of a deformable plastic can be used. However, crushable foam, for example Styrofoam, can also serve the function. The anchor bra is preferably buoyant, so that it will not sink if dropped, and is preferably light in weight so it is easy to handle.

In a preferred embodiment, the anchor bra has straps threaded through or attached to one or more attachment points on the anchor cover. The straps, made for example as flat straps of marine grade nylon, or of rubber or similar elastic material, or of "bungee cord", will preferably comprise a buckle or similar device, configured to allow the strap length to be adjustable. The strap can be reversibly fastened to the boat's gunwale or railing, or to a cleat, securing the anchor bra over the anchor, while allowing adjustment of the straps so that the anchor bra fits snugly over the anchor.

Figure 1:
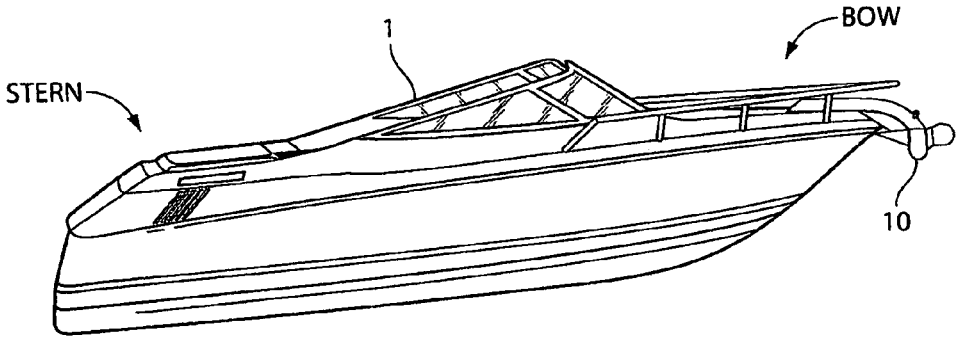
FIG. 1 is a schematic side view of a motor boat.
Figure 2A:
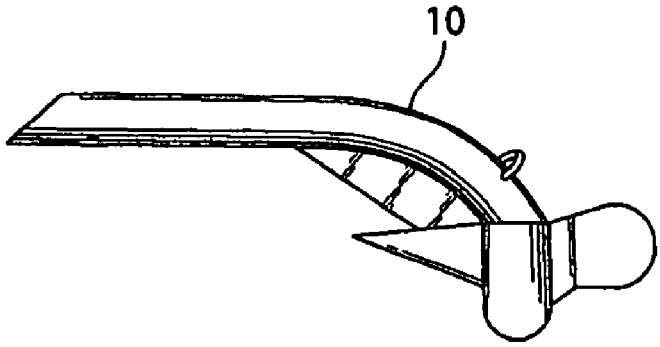
FIG. 2 shows two types of anchors (2*a*, 2*b*) and side views of corresponding anchor bras (2*c*, 2*d*).
Figure 2B:
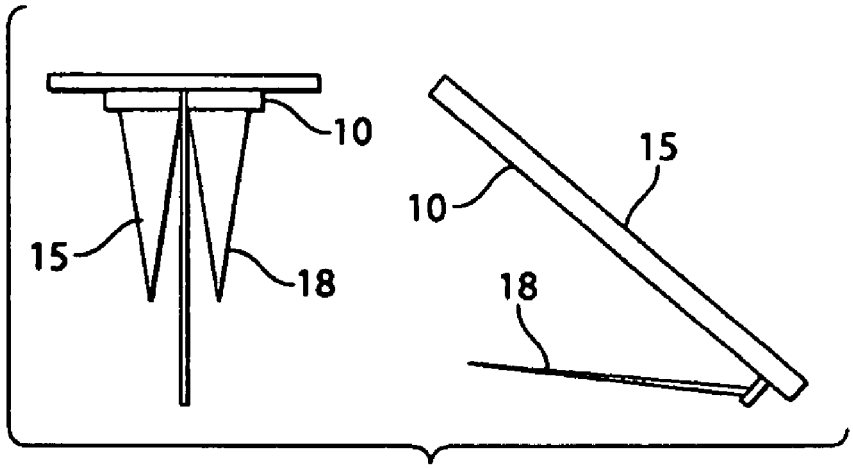
Figure 2C:
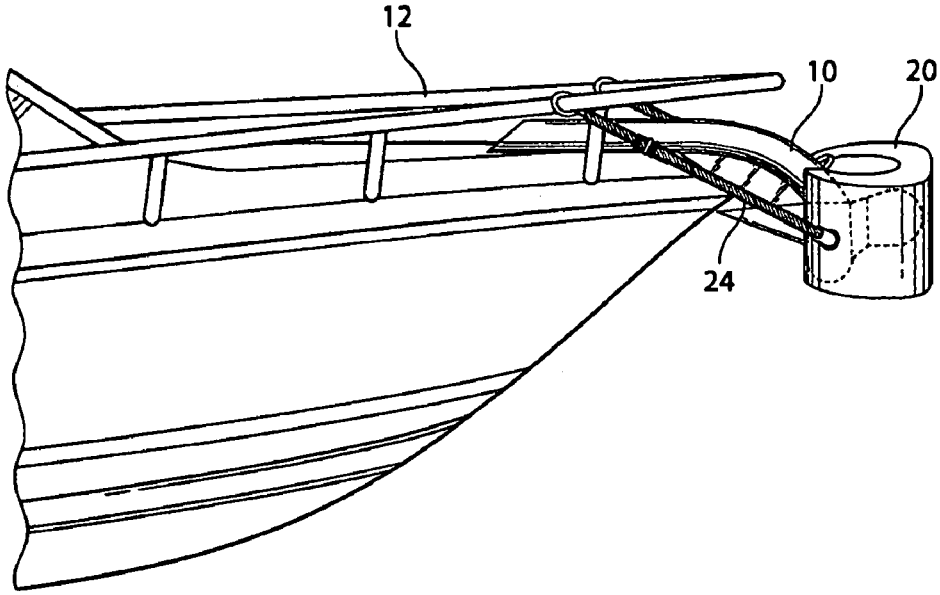
Figure 2D:
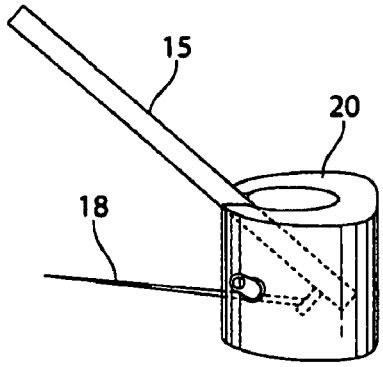

FIG. 1 shows a boat 1 with bow, stern, and raised anchor 10 at the bow. The illustrated boat has a pleasure-cruiser type of profile, but any kind of watercraft that carries an anchor can benefit from the anchor bra of the invention, including sailboats and commercial vessels, among others.

FIG. 2 shows views of two different anchor types, and of the anchors protected by anchor bras. FIG. 2*a* (upper left) shows a contemporary "stockless" type of anchor 10, while FIG. 2*b* (upper right) shows a classic type of anchor with stock 15 and flukes 18. FIGS. 2*c* and 2*d* (lower left, lower right) show the respective anchors with an anchor bra cover section 20 wrapped around the portions of the anchor that project away from the hull when the anchor is raised. (The enlarged views A, B and C are found in FIG. 5). In FIG. 2*c*, straps 24 connecting the cover 20 to the railing 12 of the boat are shown.

Figure 3:
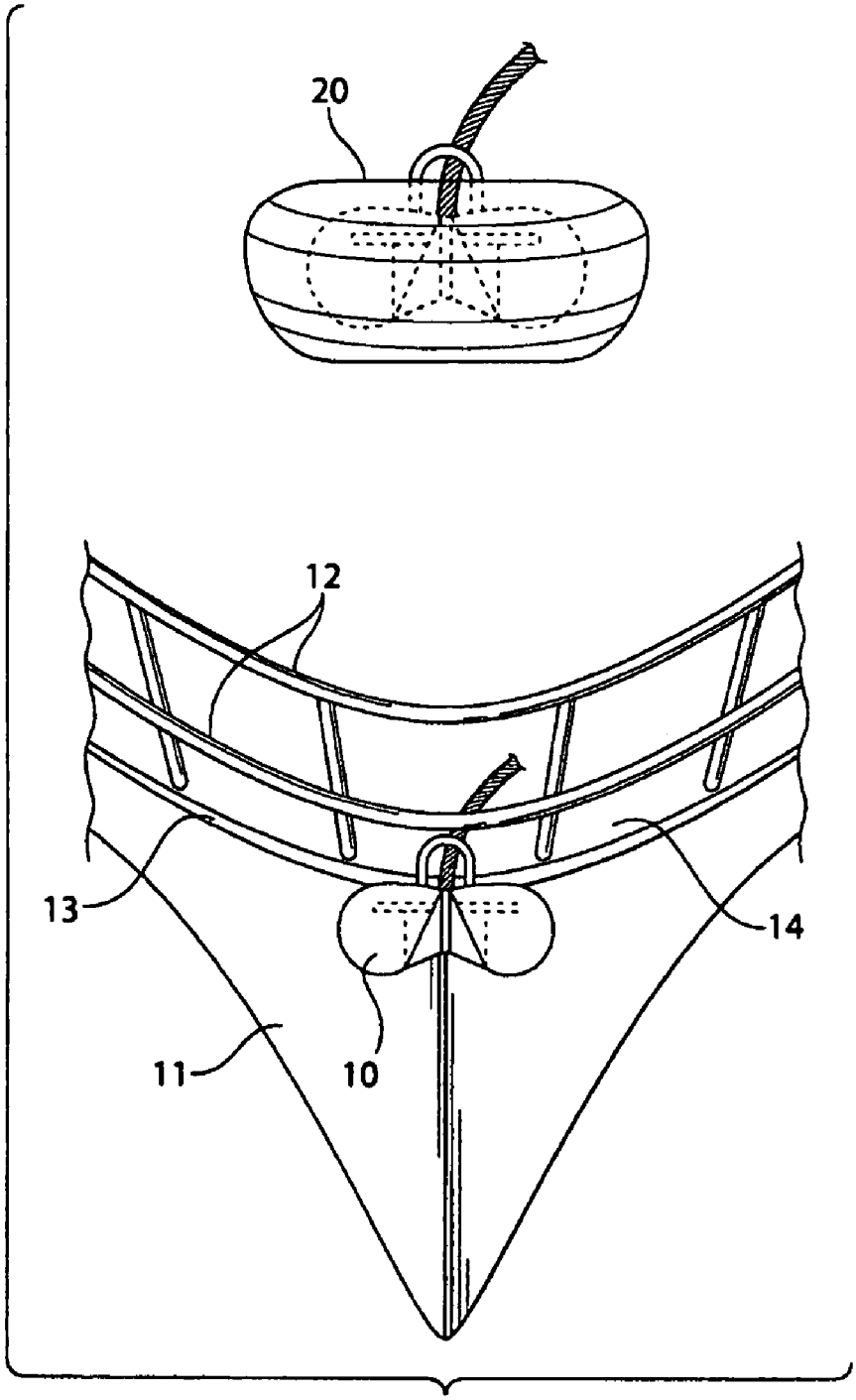
FIG. 3 is a view from in front of the bow, showing an anchor inside an anchor bra (top) and an exposed anchor on the bow (lower).

FIG. 3 (left panel, above) is a front view of a boat 1 showing an anchor (dotted lines) encased in an anchor bra 20, and below shows the general position of the anchor 10 relative to the hull 11, the railings 12, the gunwale 13, and the deck 14 of the boat.

Figure 4:
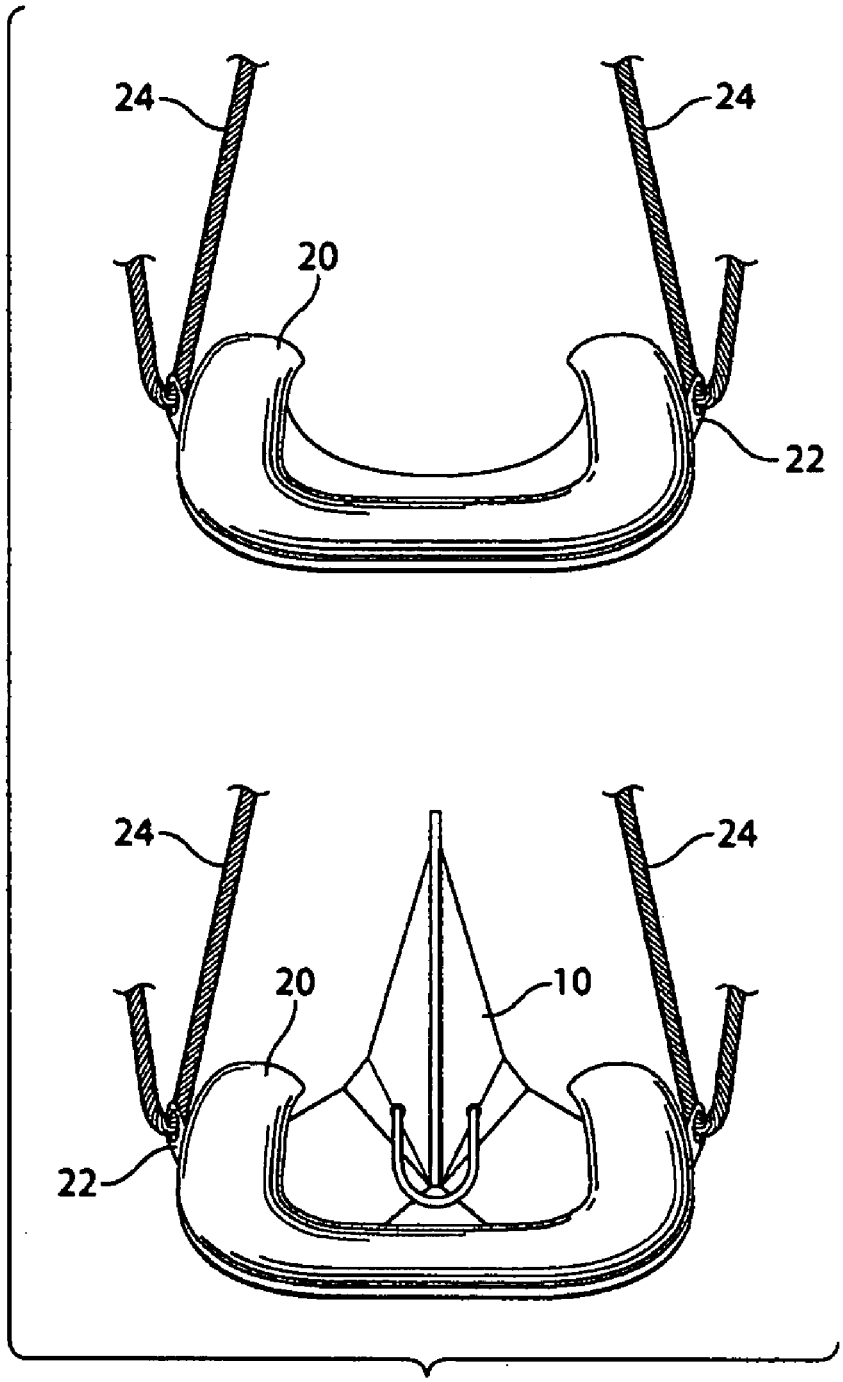
FIG. 4 shows a top view of a bra for the anchor type of FIG. 2*a* alone (upper) and positioned on an anchor (lower).

FIG. 4 (right panel) shows a top view of an anchor bra 20 by itself (upper) and positioned over an anchor 10 (lower). Straps 24 are connected to openings 22.

Figure 5:
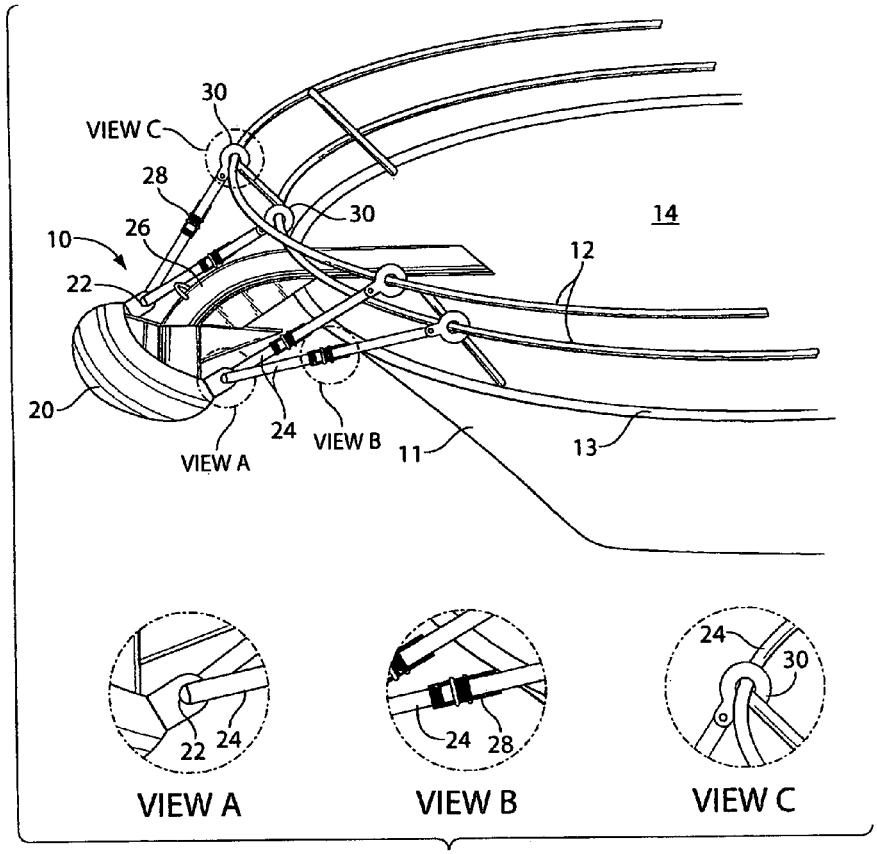
FIG. 5 shows the attachment of an anchor bra to the railings of the boat, with insets of detail.

FIG. 5 shows a perspective view of the front end of a boat 1 with a raised anchor 10 protected by an anchor bra 20 of the invention. The boat 1 has a hull 11, a deck 14, a railing 12 and a gunwale 13. The anchor 10 is connected to a rope or chain which is withdrawn into a hole in the deck (not illustrated.) The forwardly-protruding portions 26 of the anchor 10 are covered by the anchor bra 20. The bra is retained in position, in this embodiment, by four straps 24, which are connected to the anchor cover 20 at one end and to the railing 12 at the other.

Details of attachment are shown at the right of FIG. 5. View A shows the strap 24 being looped through a retaining opening 22 molded into the anchor bra 20. View B shows an adjustable buckle 28, optionally openable, in a strap 24. View C shows two possible attachments of a strap 24 to the railing or gunwale via a loop. The connecting end could instead be a snap, a buckle, a clip, a hook-loop closure ("Velcro", for instance), a tied knot, or in general any reversible form of attachment.

A number of variations are contemplated in the invention. First, the material of the anchor bra is not restricted except by suitability in use. If the anchor cover portion is an air-filled shape, the material may be any resilient material that will retain air. The material will preferably also retain its basic shape. Optionally, the bra could be reversibly inflatable, and then could be stored in the deflated state if desired.

In another option, the cover portion can be made of a foamed material. The foam could be closed cell or open cell, and more or less flexible. Open-celled foam would preferably be enclosed in a waterproof cover, ideally one that also offered resistance to the passage of air to improve cushioning. Closed-cell foam would preferably have a covering, for example of fabric, to which straps could be affixed. Alternatively, attachment points could be formed in or cut into closed-cell foam.

The attaching straps have been illustrated in a preferred embodiment as permanently attached to the anchor bra and having closeable loops for attachment to a railing of the boat or other structure. The loops could be closed by snaps, or by buckles with tongues, or by hook/loop closures ("Velcro"), or by weave-through clasps such as those found on backpacks. Generally, any kind of reversible closure found on boating equipment, sporting equipment, or other outdoor equipment for a wet environment is potentially suitable for use in the invention. Optionally, the straps can be attached at one or both ends simply by tying knots. The straps are illustrated as attaching to a railing, but could also be attached to a cleat, a jam cleat, a loop, a stay, a stanchion, a mast, a bowsprit, or any other suitable attachment point.

In some cases, the anchor after raising will be wholly or partially below the level of the deck. In such a case, the lower straps of the anchor bra can be replaced with loops or other structures (hooks, grapples, and others) which can be caught under or on the flukes or other parts of the anchor, or on another external structure (which can include a cleat or other holder affixed to the hull); and then a pair of upper straps can be affixed to a railing, or to another structure on boat, for example on the deck or the hull, as described above, to position the anchor bra over the raised anchor.

Since anchors come in a range of sizes and shapes, several sizes and shapes of anchor bra will be manufactured. At one extreme, the anchor bra will be loose fitting and each size will cover a variety of anchors. At the other extreme, the anchor bra will be fitted to the particular anchor, and perhaps sold with it.

A secondary use of the device of the anchor bra of the invention may be to cover other protruding above-water parts of a boat in a simple, reversible manner. Such parts include lights, horns, capstans and winches, or equivalents. In particular, this can provide a place to store the anchor bra when the anchor is in use.

The invention has been illustrated in a particular embodiment to enable the understanding of the invention. Equivalents may occur to the skilled person, and some have been described. The scope of the invention is not limited by the examples or to the named alternative materials, attachment methods, etc., but only by the claims.

The invention claimed is:

1. A method of covering a raised protruding boat anchor on a boat to reduce or avoid damage during a collision of the anchor with one or more of a person and an object, other than a person or object on said boat, the method comprising:

providing a resilient anchor bra, the anchor bra surrounding at least part of the anchor and having an ability to yield on contact;

applying said anchor bra to said anchor while said anchor is raised above the waterline;

and retaining said anchor bra in place by affixing said anchor bra to said boat;

wherein the resiliency of the anchor bra is provided by at least one of an air-filled structure and a deformable shell;

and wherein the anchor bra is retained by affixing said anchor bra to one or more points on said boat selected from one or more of railings, gunwales, cleats, jam cleats, rings, hooks, sprits, stays, and masts;

whereby the resiliency of said anchor bra, while covering said raised protruding anchor, reduces or avoids damage to other persons or objects that would otherwise have occurred.

2. The method of claim 1 where the anchor bra comprises a sealed resilient bladder with walls sufficiently strong to maintain a fixed shape when at rest.

3. The method of claim 1 where the anchor bra comprises an inflatable device or series of inflatable devices that provide a resilient anchor cover when inflated.

4. The method of claim 1 where the anchor bra comprises an air-filled foam.

5. The method of claim 1 wherein the retaining connectors between the anchor bra and the boat can be put in place or can be removed while the boat is under way.

6. The method of claim 1 wherein the anchor bra further comprises elements which are at least one of reflective and colored, to enhance the visibility of the anchor when covered.

7. The method of claim 1 wherein the anchor bra comprises connecting means by which it may be affixed to said boat.

8. In combination with a boat a resilient anchor bra for minimizing damage, from collision with a protruding anchor on the boat, to other boats or to persons other than those on said boat, wherein the anchor bra comprises: a yielding anchor cover section, the section having a shape when in use that provides a cavity covering at least part of said anchor; the anchor bra being removably attached to attachment points on the boat by connecting means;

wherein the connecting means and the attachment points are constructed and arranged so that the anchor bra can be removed and applied while the boat is under way;

and wherein the yielding of the anchor cover is provided by a resilient structure which is at least one of an air-filled structure and a deformable shell;

and wherein the attachment points are selected from one or more of railings, gunwales. cleats, jam cleats, rings, hooks, sprits, stays, and masts;

whereby when the anchor bra surrounds the anchor by connecting to the attachment points, the anchor bra is positioned above the waterline;

and whereby damage to other boats or to persons other than those on said boat is reduced by the resiliency of the resilient structure.

9. The anchor bra of claim 8 where the anchor cover comprises a sealed resilient bladder with walls sufficiently strong to maintain a fixed shape when at rest.

10. The anchor bra of claim 8 where the anchor cover comprises an inflatable device or series of inflatable devices that provide a resilient anchor cover when inflated.

11. The anchor bra of claim 8 where the anchor cover comprises an air-filled foam.

12. The anchor bra of claim 11 where the foam comprises a rigid, closed-cell foam.

13. The anchor bra of claim 8 wherein the connecting means are selected from one or more of straps, ropes, elastic members, hooks, and loops.

* * * * *